US010567894B1

(12) United States Patent
Ivey

(10) Patent No.: US 10,567,894 B1
(45) Date of Patent: Feb. 18, 2020

(54) LOUDSPEAKER PLACEMENT VISUALIZER SYSTEM

(71) Applicant: MITEK CORP., INC., Phoenix, AZ (US)

(72) Inventor: Johnathan Ivey, Chandler, AZ (US)

( * ) Notice: Subject to any disclaimer, the term of this patent is extended or adjusted under 35 U.S.C. 154(b) by 7 days.

(21) Appl. No.: 16/266,036

(22) Filed: Feb. 2, 2019

(51) Int. Cl.
*H04R 29/00* (2006.01)
*G08B 5/36* (2006.01)

(52) U.S. Cl.
CPC ..... *H04R 29/001* (2013.01); *G08B 5/36* (2013.01)

(58) Field of Classification Search
CPC ..... H04R 29/001; G08B 5/36
See application file for complete search history.

(56) References Cited

U.S. PATENT DOCUMENTS 6,157,591 A * 12/2000 Krantz ..... G01S 15/025 367/107
2001/0029675 A1* 10/2001 Webb ..... G01C 15/00 33/286
2014/0250757 A1* 9/2014 Werner ..... F41G 1/35 42/115
2018/0063665 A1* 3/2018 Walker ..... G06F 3/04817
2018/0188095 A1* 7/2018 Hu ..... G01F 23/2965

* cited by examiner

*Primary Examiner* — Mark Fischer
(74) *Attorney, Agent, or Firm* — Keith L. Jenkins, Registered Patent Attorney, LLC; Kieth L. Jenkins

(57) ABSTRACT

A loudspeaker placement visualizer system includes a calibrated adjustable laser beam tool that can generate a beam cone angle corresponding to the predetermined sound dispersion angle of a loudspeaker. The tool is secured parallel to the central axis of the loudspeaker and adjusted to the predetermined sound dispersion angle to show what the acoustic coverage area of the loudspeaker will be in a particular venue. The laser beam projector has a cylindrical main body with an external reference indicator and a forward section that is rotatable relative to the main body to adjust the laser beam cone angle. The forward section has a calibrated scale proximate the reference indicator to enable the user to set and to see the beam cone angle. The tool may also be used during venue survey and acoustic design to determine the required sound dispersion angle of a loudspeaker to be installed.

20 Claims, 11 Drawing Sheets

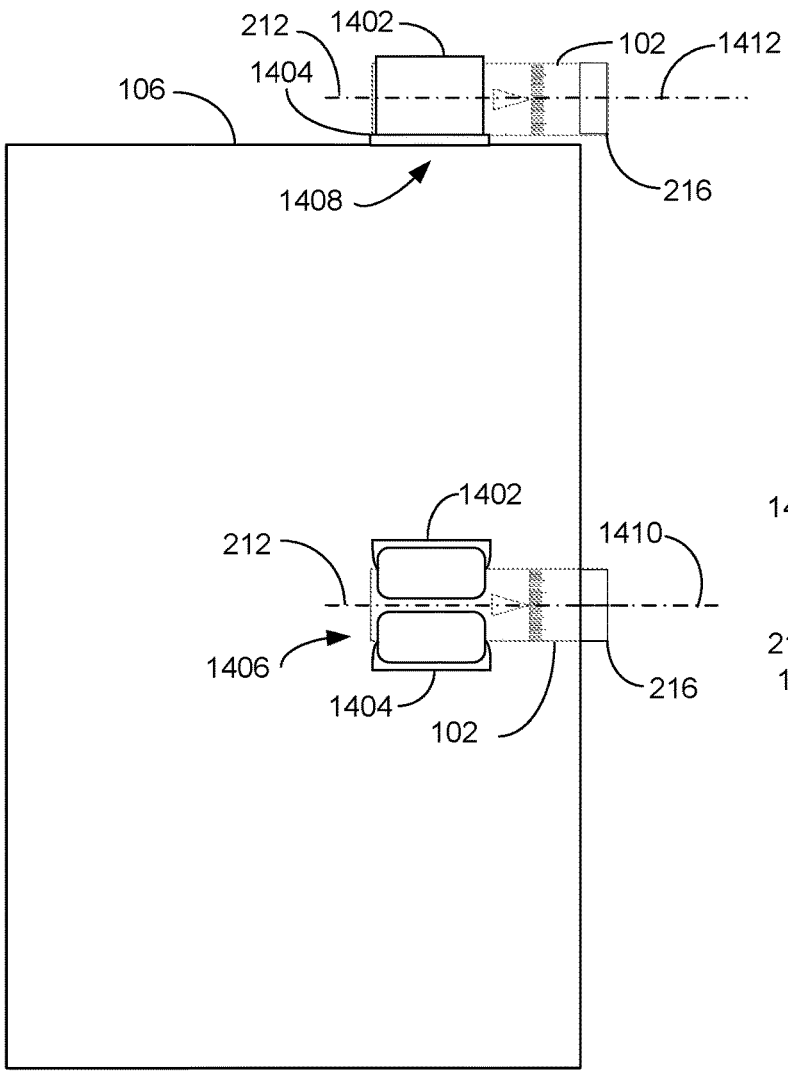
FIG. 14
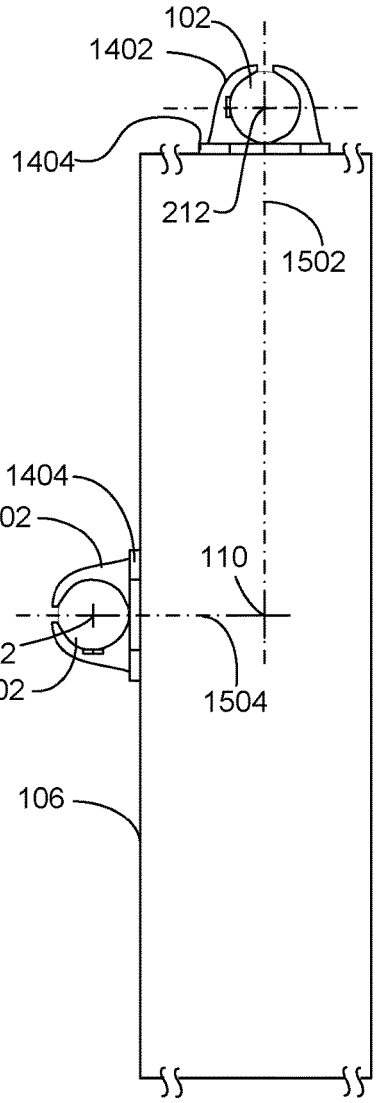
FIG. 15
FIG. 16
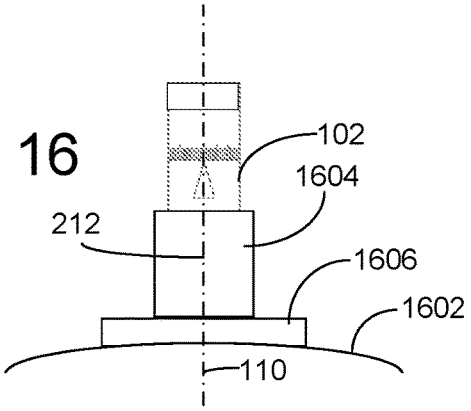
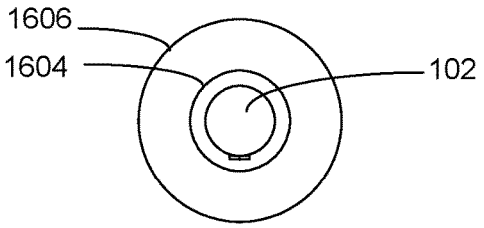
FIG. 17

LOUDSPEAKER PLACEMENT VISUALIZER SYSTEM

FIELD OF ART

The present invention relates to an apparatus for visualizing the sound dispersion of an audio loudspeaker. The present invention more particularly relates to a laser beam tool with an adjustable beam cone angle that matches the predetermined sound dispersion angle of the loudspeaker.

BACKGROUND OF THE INVENTION

Acoustic installations in buildings, especially auditoriums, malls, concert halls, and acoustic venues generally, are made difficult because the exact sound dispersion angle of the loudspeakers is difficult to visualize. As a result, slow and costly trial and error must be used to get the best acoustic coverage for the venue. Alternatively, undesirably expensive computer models of each venue may be made and simulations run to determine the desired loudspeaker placement.

SUMMARY OF THE INVENTION

The present invention provides a compact adjustable laser beam tool with an adjustable beam cone angle that is calibrated and can be selected by the user to correspond to the predetermined sound dispersion angle of the loudspeaker. The adjustable laser beam tool has a cylindrical main body holding a power supply and a forward laser-projecting section that is rotatable about the main body's long axis to move to select the beam cone angle. The main body has a reference indicator on its exterior surface proximate the forward section and the forward section has calibration marks, in angular degrees. By aligning the desirable calibration mark with the reference indicator, the correct laser beam cone angle is established. The present invention is primarily for use at an acoustic venue during installation, design, or remodeling.

DESCRIPTION OF THE FIGURES OF THE DRAWINGS

The present invention will hereinafter be described in conjunction with the following drawing figures, wherein like numerals denote like elements.

FIG. 14 is a side diagrammatic elevation view illustrating the exemplary embodiment of the loudspeaker placement visualizer system of FIG. 1, according to a preferred embodiment of the present invention;

FIG. 15 is a front diagrammatic elevation view illustrating the exemplary embodiment of the loudspeaker placement visualizer system of FIG. 1, according to a preferred embodiment of the present invention;

FIG. 16 is a side diagrammatic elevation view illustrating the exemplary embodiment of the loudspeaker placement visualizer system of FIG. 1, according to a preferred embodiment of the present invention;

FIG. 17 is a top plan diagrammatic view illustrating the exemplary embodiment of the loudspeaker placement visualizer system of FIG. 1, according to a preferred embodiment of the present invention.

DETAILED DESCRIPTION OF THE INVENTION

Figure 1:
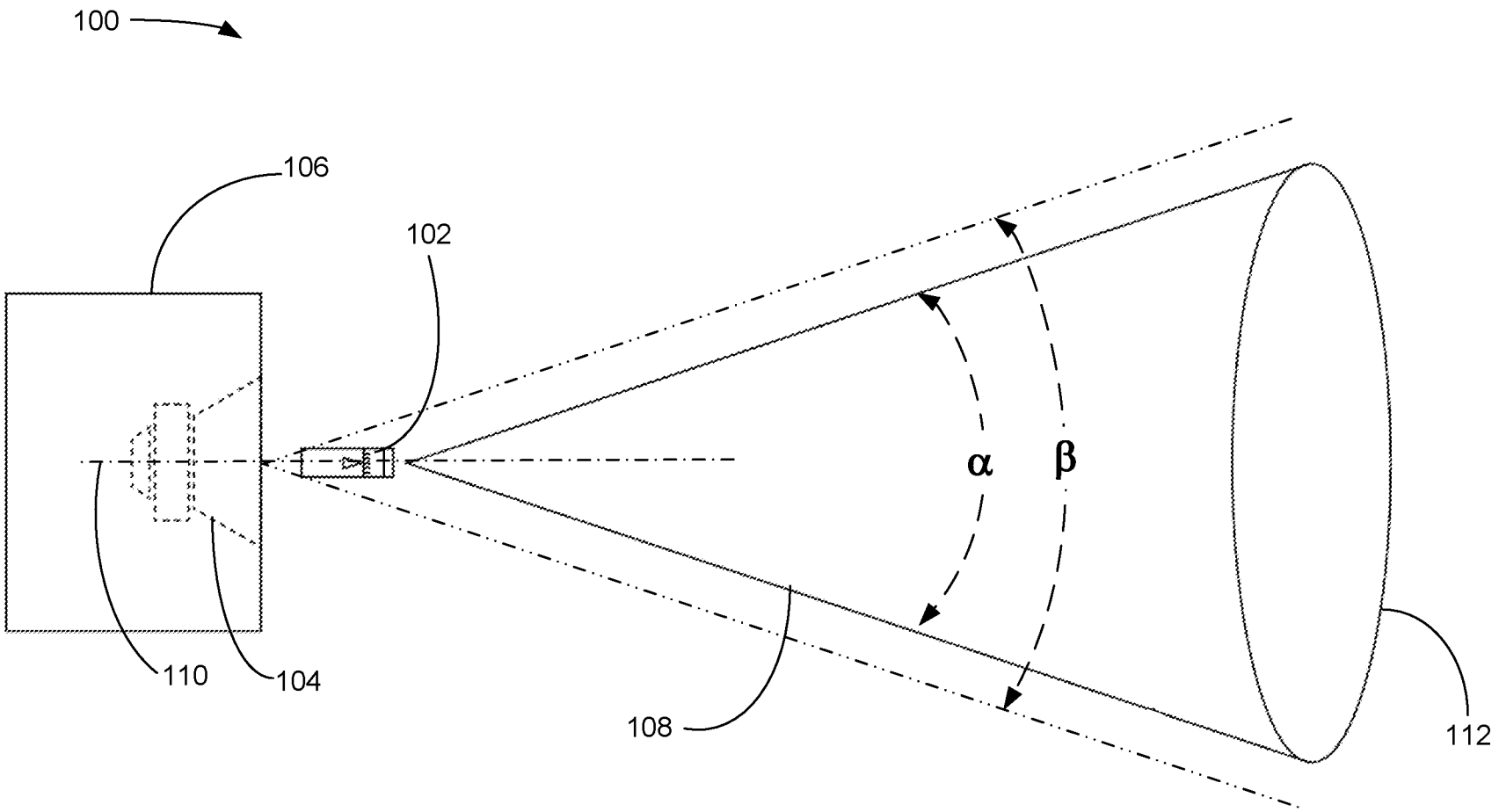
FIG. 1 is a side diagrammatic view illustrating an exemplary embodiment of a loudspeaker placement visualizer system, according to a preferred embodiment of the present invention.

FIG. 1 is a side diagrammatic view illustrating an exemplary embodiment of a loudspeaker placement visualizer system 100, according to a preferred embodiment of the present invention. Speaker placement visualizer system 100 includes an adjustable laser beam tool 102, a loudspeaker 104 having a predetermined sound dispersion angle β, a loudspeaker cabinet 106, and brackets. Adjustable laser beam tool 102 emits a laser beam with a cone angle α that corresponds to the predetermined sound dispersion angle β of the loudspeaker 104 in speaker cabinet 106. The illustrated separation between the sound dispersion angle β and the cone angle α is exaggerated for clarity of the drawing. In practice, the sound dispersion angle β and the cone angle α are closely aligned. Speaker 104 has a central axis 110 to which the long axis 212 (see FIG. 2) of adjustable laser beam tool 102 may be aligned, as shown. Adjustable laser beam tool 102 draws a circular pattern 112 on the sound system installation venue.

Figure 2:
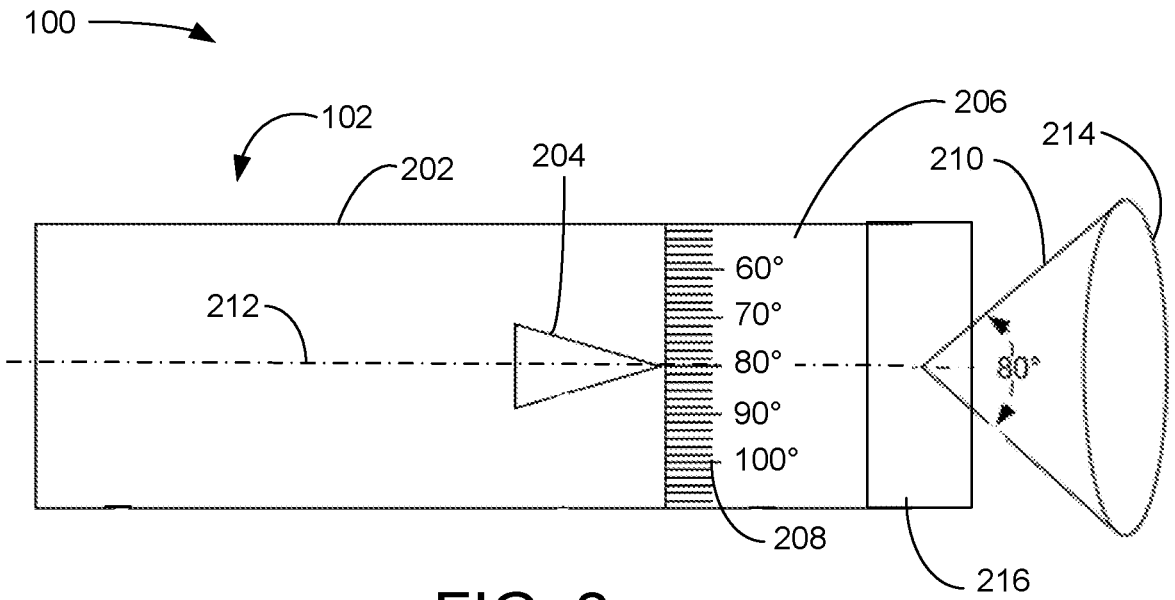
FIG. 2 is a side elevation view illustrating the exemplary embodiment of the adjustable laser beam tool of FIG. 1, according to a preferred embodiment of the present invention.

FIG. 2 is a side elevation view illustrating the exemplary embodiment of the adjustable laser beam tool 102 of FIG. 1, according to a preferred embodiment of the present invention. Adjustable laser beam tool 102 has a cylindrical main body 202 having an external fixed reference indicator 204. Forward section 206 is rotatable about a long axis 212 of the cylindrical main body 202. A transparent cap 216 is attached to the forward section 206 and rotates with forward section 206. Calibrations 208 are fixed on the outer surface of the forward section 206. By rotating the forward section 206 about the long axis 212 of the cylindrical main body 202, the user may align a particular calibration angle 208 to the reference indicator 204, thereby establishing a laser beam 210 having a cone angle (80° in this illustration) equal to the calibrated 208 value (80° in this illustration) aligned to the reference indicator 204. A circular pattern 214 is created by the Adjustable laser beam tool 102. The cylindrical main body 202 and the forward section 206 are preferably right circular cylindrical shells, but various cross sectional shapes, such as polygonal, conic section, or irregular shapes may be used in respective various embodiments. The desired cone angle α is determined from a predetermined value of the loudspeaker's 104 sound dispersion angle β. The predetermined sound dispersion angle β may be determined by the manufacturer of the loudspeaker 104.

The laser 1002 (see FIG. 10) is preferably a solid-state laser for achieving brightness with low power consumption. The power supply is housed in the cylindrical main body 202 and is preferably a USB rechargeable power supply.

Figure 3:
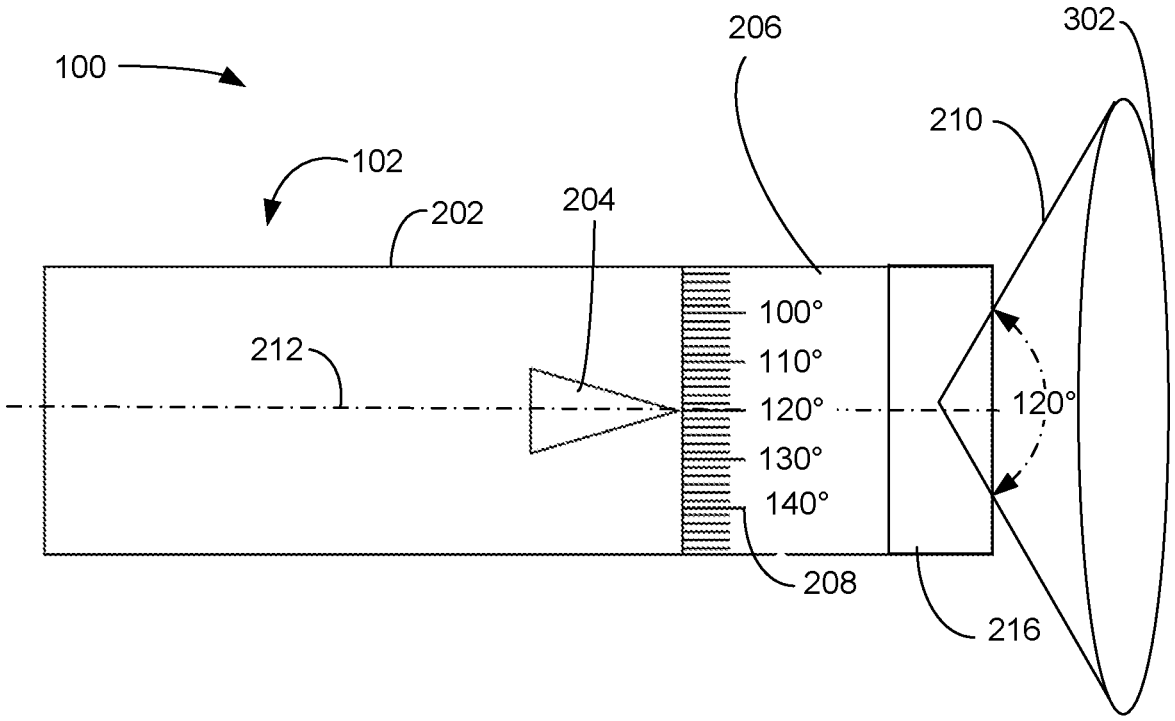
FIG. 3 is a side elevation view illustrating the exemplary embodiment of the adjustable laser beam tool of FIG. 1, according to a preferred embodiment of the present invention.

FIG. 3 is a side elevation view illustrating the exemplary embodiment of the adjustable laser beam tool 102 of FIG. 1, according to a preferred embodiment of the present invention. Forward section 206 is rotated, relative to FIG. 2, to produce a laser beam 210 having a cone angle α (120° in this illustration) equal to the calibrated 208 value (120° in this illustration) aligned to the reference indicator 204. The range of values of the calibrations 208 will be greater than zero and up to one hundred and eighty degrees. By virtue of the larger cone angle α, the circular pattern 302 is larger than circular pattern 214.

Figure 4:
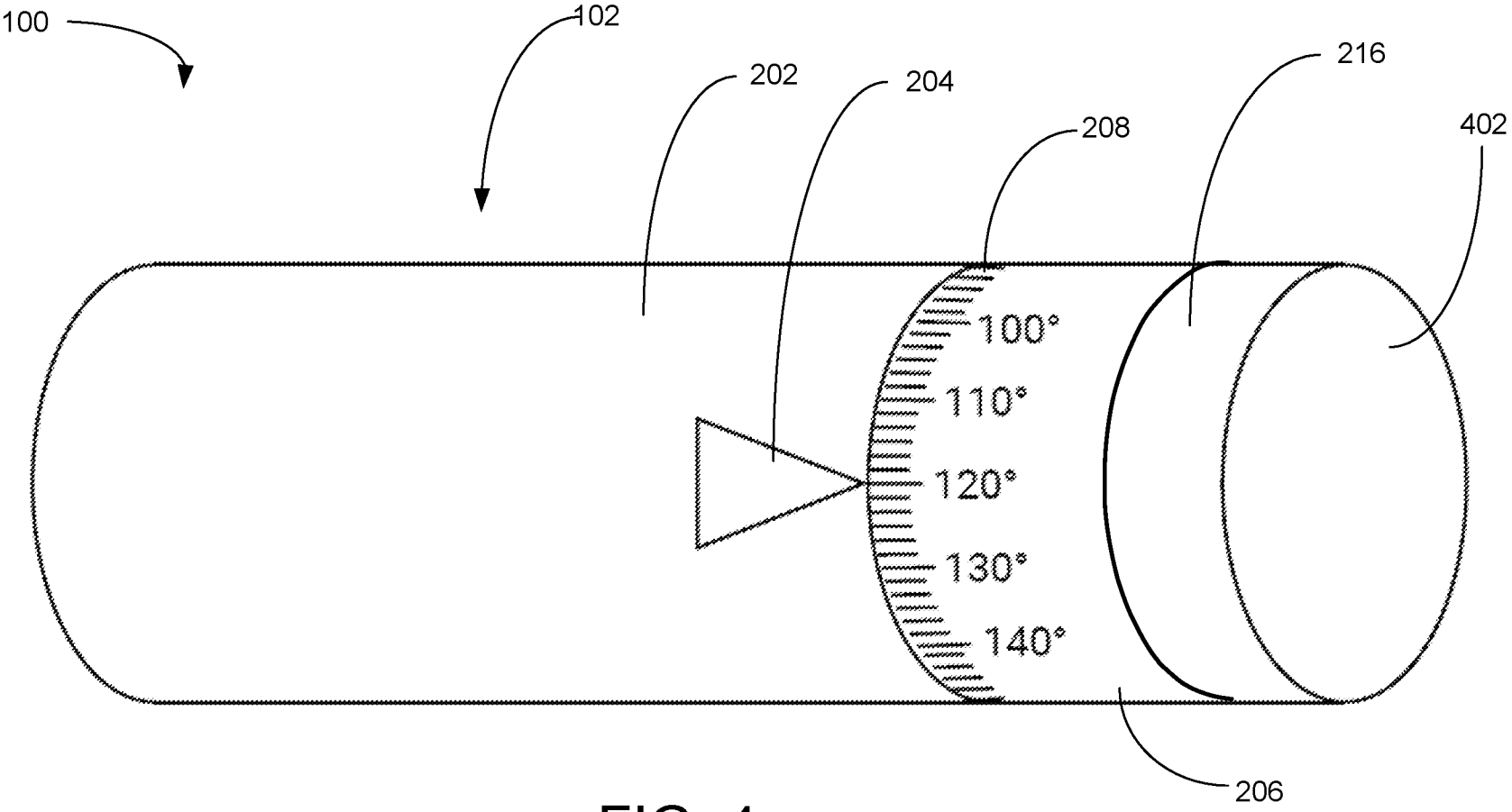
FIG. 4 is a side perspective view illustrating the exemplary embodiment of the adjustable laser beam tool of FIG. 1, according to a preferred embodiment of the present invention.

FIG. 4 is a side perspective view illustrating the exemplary embodiment of the adjustable laser beam tool 102 of FIG. 1, according to a preferred embodiment of the present invention. Transparent cap 216 has a flat front surface 402 and is mounted in the forward section 206. A laser 1006 (see FIG. 10) is housed in forward section 206, and the laser projector 1002 (see FIG. 10) changes the beam cone angle α depending on the calibration 208 selected. The cylindrical shape of the transparent cap 216 is not a limitation of the present invention. For non-limiting examples, the transparent cap 216 may be hemispherical or otherwise arcuate. Any beam deflection caused by the transparent cap 216 is taken into account in establishing the calibrations 208, which are not required to be linearly spaced apart.

Figures 5A, 5B, 5C:
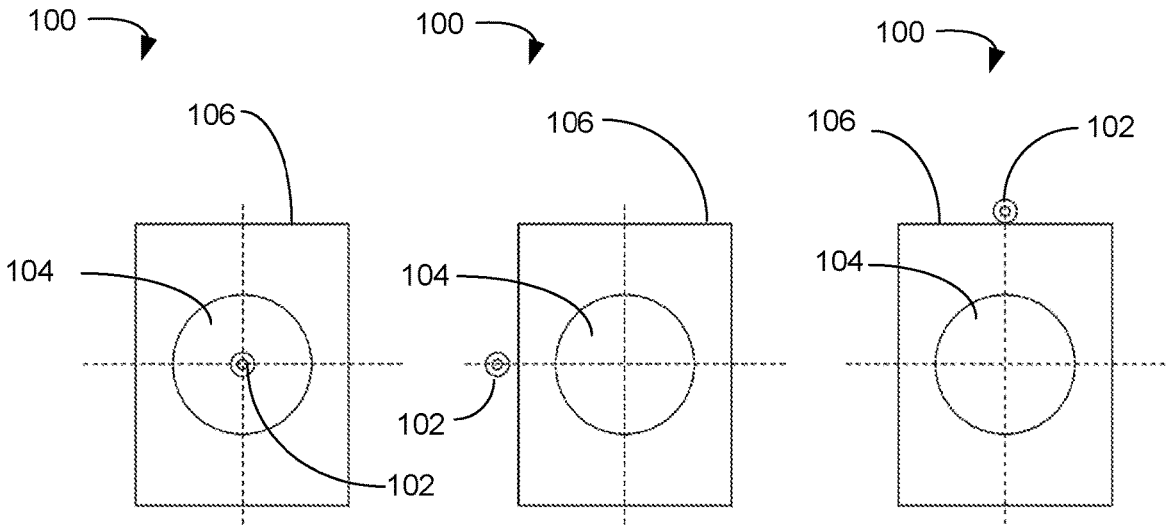
FIG. 5A is a front elevation view illustrating the exemplary embodiment of the loudspeaker placement visualizer system of FIG. 1, according to a preferred embodiment of the present invention.
FIG. 5B is a front elevation view illustrating the exemplary embodiment of the loudspeaker placement visualizer system of FIG. 1, according to a preferred embodiment of the present invention.
FIG. 5C is a front elevation view illustrating the exemplary embodiment of the loudspeaker placement visualizer system of FIG. 1, according to a preferred embodiment of the present invention.

FIG. 5A is a front elevation view illustrating the exemplary embodiment of the loudspeaker placement visualizer system 100 of FIG. 1, according to a preferred embodiment of the present invention. In a first method of use, adjustable laser beam tool 102 is aligned to the center of speaker 104 in speaker cabinet 106 and along the central axis 110, as shown. Adjustable laser beam tool 102 may be hand held or may be supported on a bracket (not shown).

FIG. 5B is a front elevation view illustrating the exemplary embodiment of the loudspeaker placement visualizer system 100 of FIG. 1, according to a preferred embodiment of the present invention. In a second method of use, Adjustable laser beam tool 102 is aligned to the vertical center of speaker 104 in speaker cabinet 106, and supported at the side of the loudspeaker cabinet 106, as shown. Adjustable laser beam tool 102 is aligned parallel to the central axis 110 of speaker 104. Adjustable laser beam tool 102 may be hand held or may be supported on a bracket (not shown).

FIG. 5C is a front elevation view illustrating the exemplary embodiment of the loudspeaker placement visualizer system 100 of FIG. 1, according to a preferred embodiment of the present invention. In a third method of use, adjustable laser beam tool 102 is aligned to the horizontal center of speaker 104 in speaker cabinet 106, and supported at the top of the loudspeaker cabinet 106, as shown. Adjustable laser beam tool 102 is aligned parallel to the central axis 110 of speaker 104. Adjustable laser beam tool 102 may be hand held or may be supported on a bracket (not shown) or other fastener, such as a hook and loop fastener.

Figure 6:
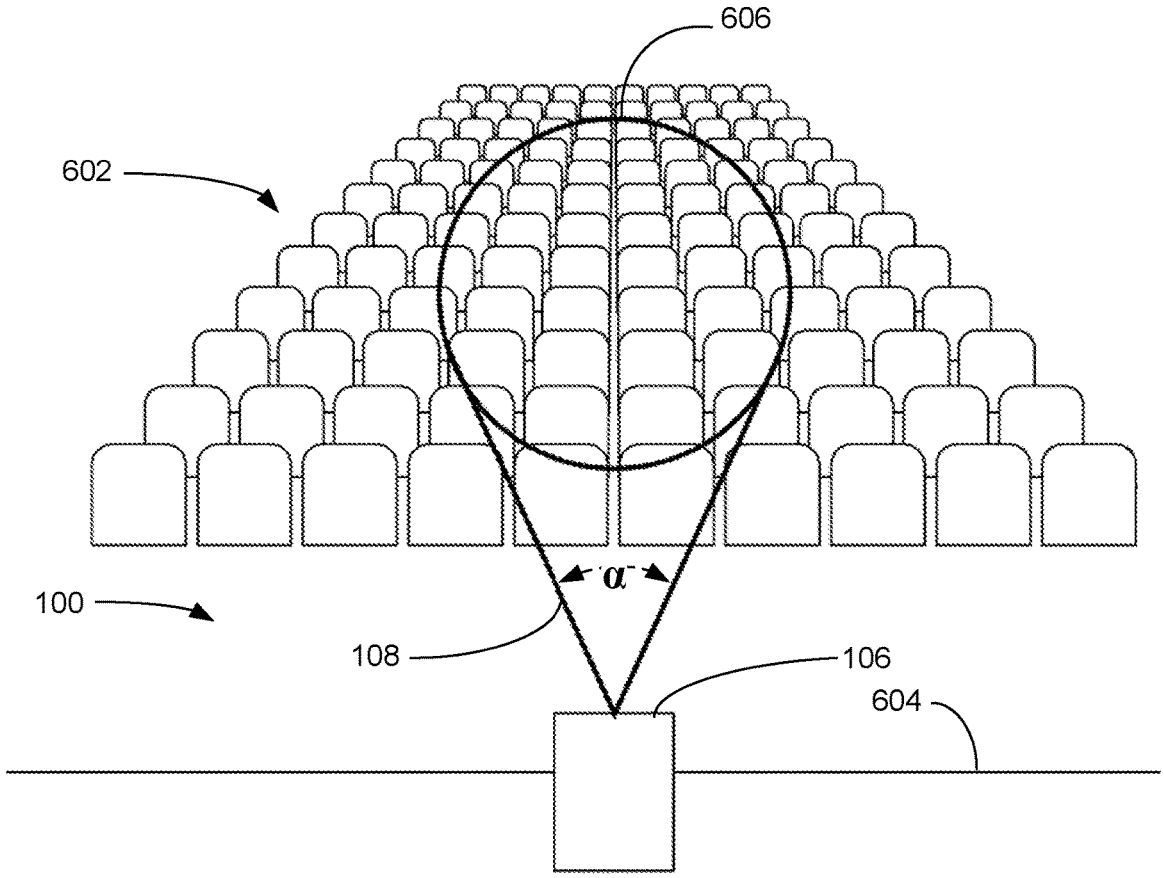
FIG. 6 is a rear diagrammatic perspective view illustrating the exemplary embodiment of the loudspeaker placement visualizer system of FIG. 1, according to a preferred embodiment of the present invention.

FIG. 6 is a rear diagrammatic perspective view illustrating the exemplary embodiment of the loudspeaker placement visualizer system 100 of FIG. 1, according to a preferred embodiment of the present invention. Speaker cabinet 106 rests on stage 604 and centered adjustable laser beam tool 102 projects a beam 108 to outline an acoustic coverage area 606 on auditorium seats 602. Given that the laser beam cone angle α is adjusted to the sound dispersion angle of the loudspeaker 104 (not visible in this view), the acoustic coverage area 606 covers a small portion of the whole auditorium.

Figure 7:
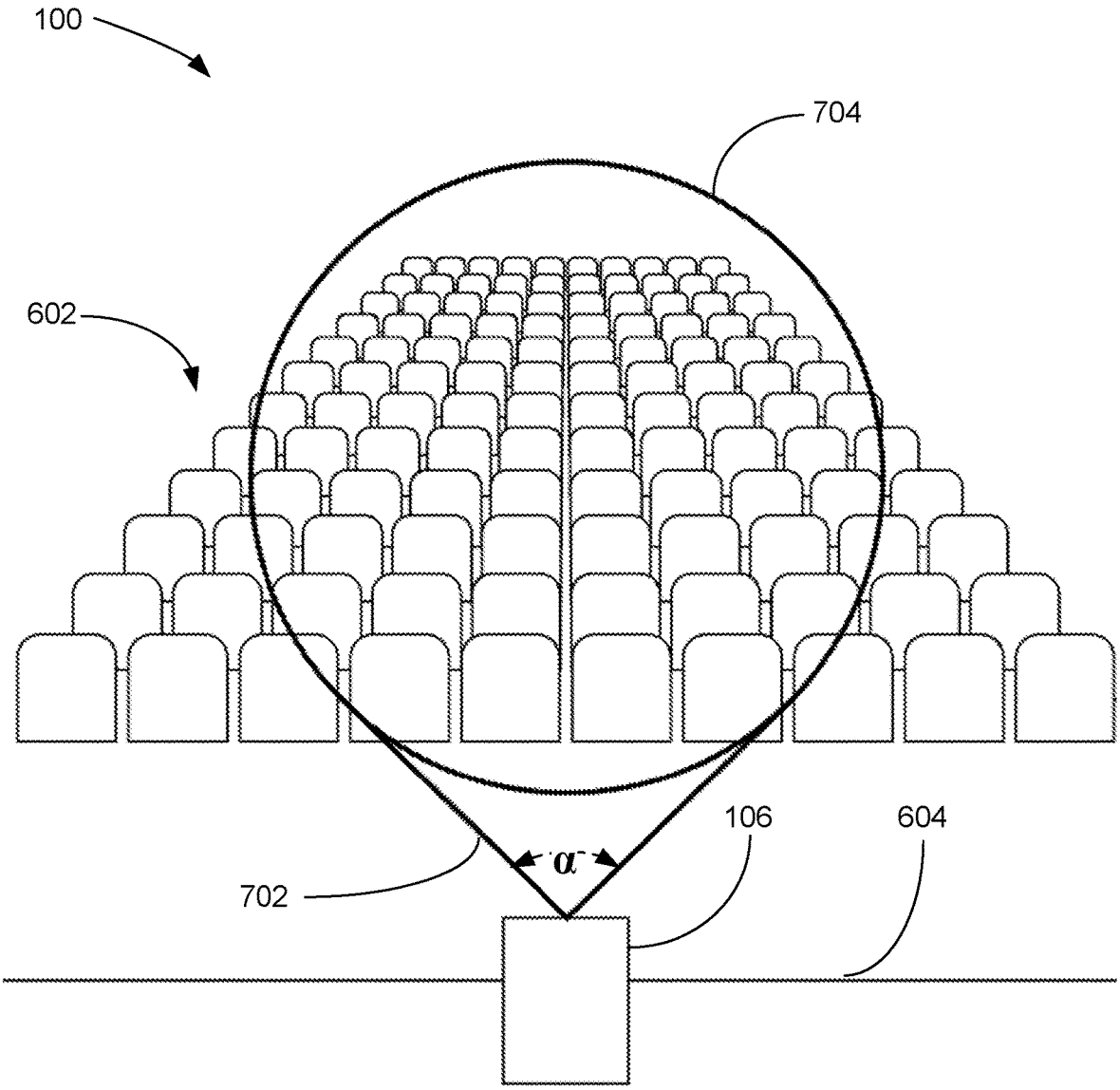
FIG. 7 is a rear diagrammatic perspective view illustrating the exemplary embodiment of the loudspeaker placement visualizer system of FIG. 1, according to a preferred embodiment of the present invention.

FIG. 7 is a rear diagrammatic view illustrating the exemplary embodiment of the loudspeaker placement visualizer system 100 of FIG. 1, according to a preferred embodiment of the present invention. Speaker cabinet 106 rests on stage 604 and centered adjustable laser beam tool 102 projects a beam 702 to outline an acoustic coverage area 704 on auditorium seats 602. Given that the laser beam cone angle α is adjusted to the sound dispersion angle of the loudspeaker 104 (not visible in this view), the acoustic coverage area 704 covers a larger portion of the auditorium seats 602.

Figure 8:
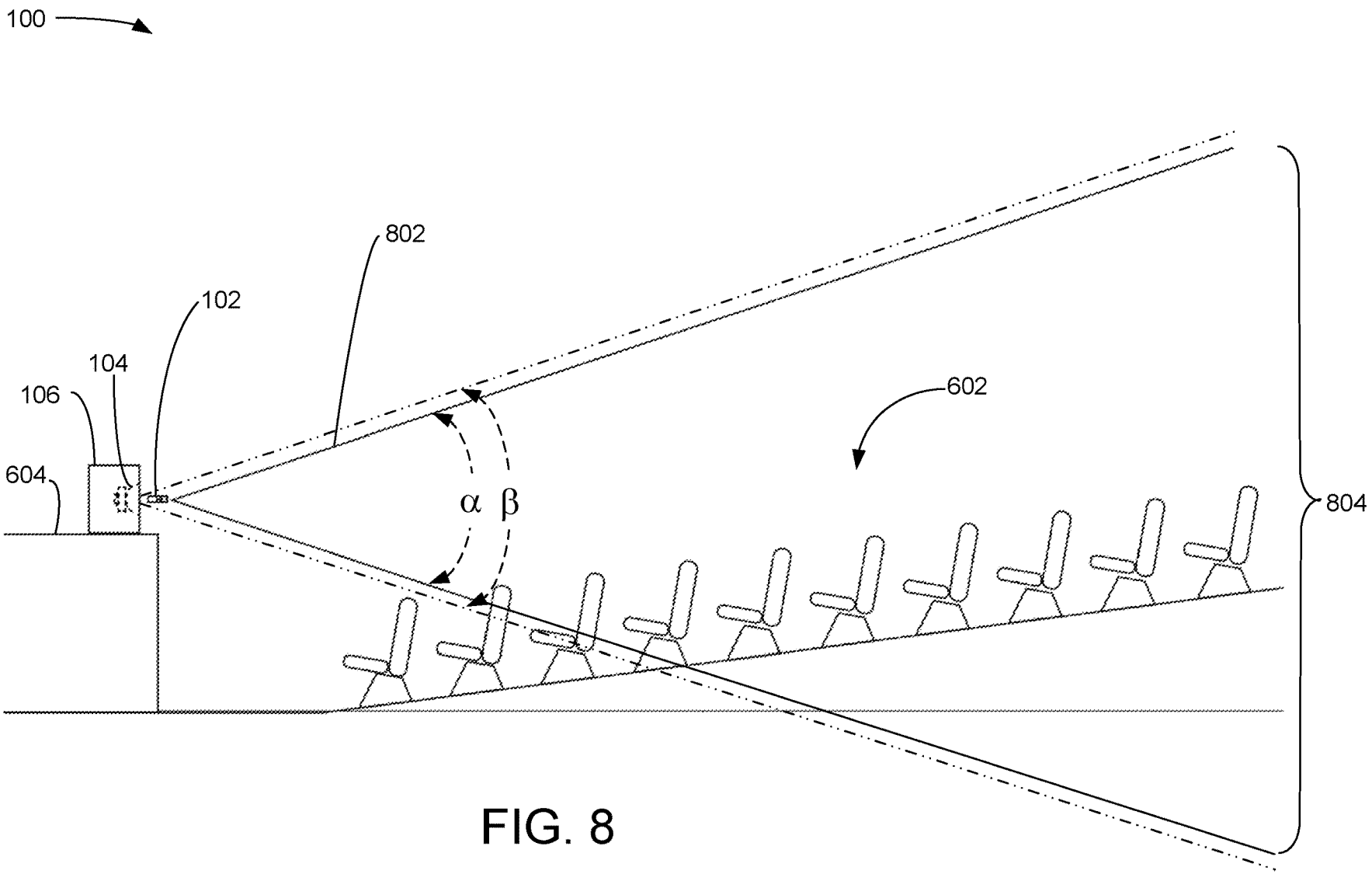
FIG. 8 is a side diagrammatic view illustrating the exemplary embodiment of the loudspeaker placement visualizer system of FIG. 1, according to a preferred embodiment of the present invention.

FIG. 8 is a side diagrammatic view illustrating the exemplary embodiment of the loudspeaker placement visualizer system 100 of FIG. 1, according to a preferred embodiment of the present invention. Speaker cabinet 106 rests on stage 604 and centered adjustable laser beam tool 102 projects a laser beam 802 to outline acoustic coverage area 804 on auditorium seats 602. The illustrated separation between the sound dispersion angle β and the conical beam cone angle α is exaggerated for clarity of the drawing. In practice, the sound dispersion angle β and the beam cone angle α are closely aligned. Given that the laser beam cone angle α is adjusted to the sound dispersion angle β of the loudspeaker 104, the acoustic coverage area 804 outlined misses a front portion of the auditorium seats 602 and projects a large portion of the sound above the seats 602.

Figure 9:
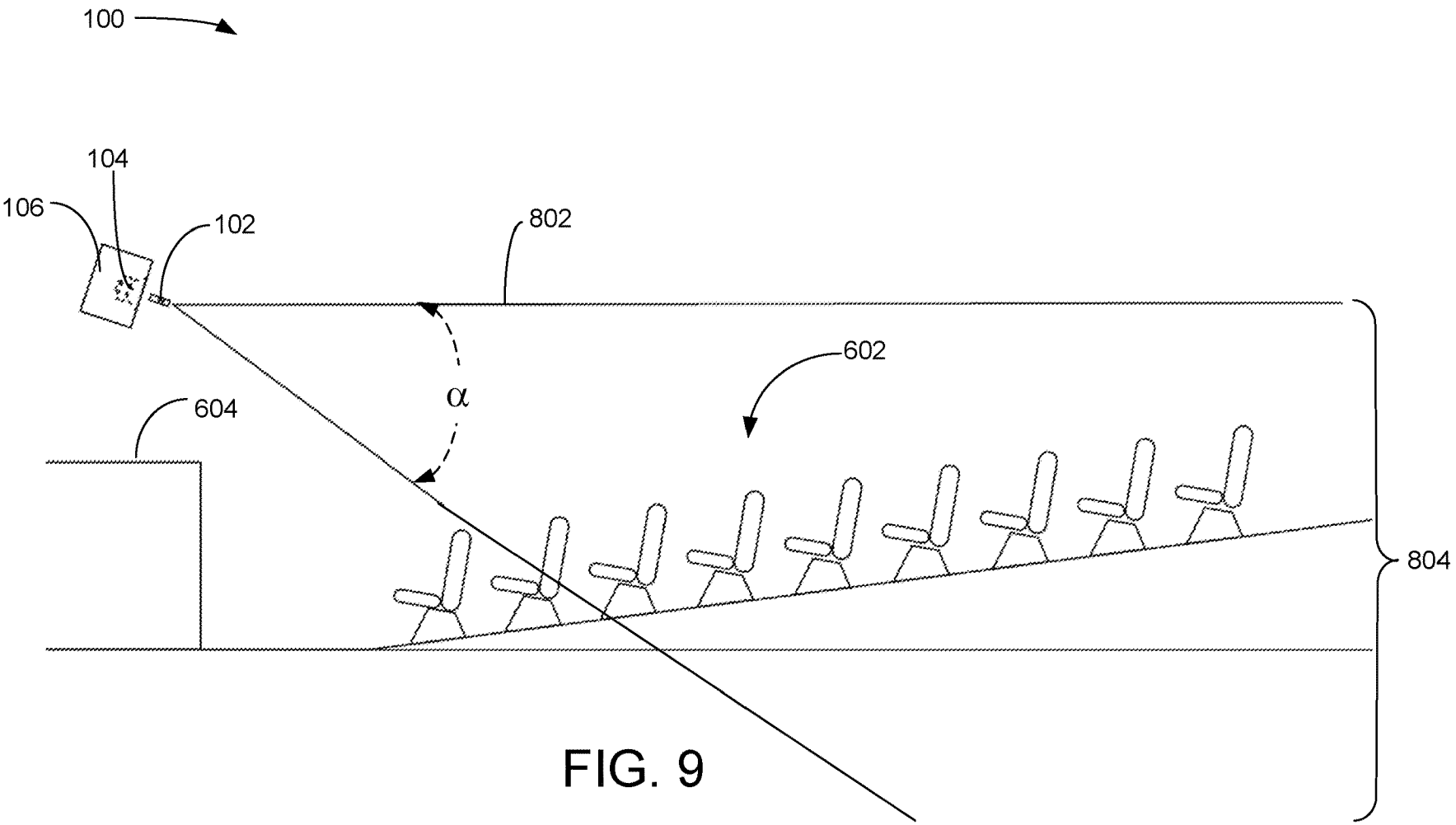
FIG. 9 is a side diagrammatic view illustrating the exemplary embodiment of the loudspeaker placement visualizer system of FIG. 1, according to a preferred embodiment of the present invention.

FIG. 9 is a side diagrammatic view illustrating the exemplary embodiment of the loudspeaker placement visualizer system of FIG. 1, according to a preferred embodiment of the present invention. Speaker cabinet 106 is wall, tower, or ceiling mounted and centered adjustable laser beam tool 102 projects a laser beam 802 to outline acoustic coverage area 804 on auditorium seats 602. Given that the laser beam cone angle $\alpha$ is adjusted to the sound dispersion angle of the loudspeaker 104, the acoustic coverage area 804 covers all listeners in the auditorium seats 602.

Figure 10:
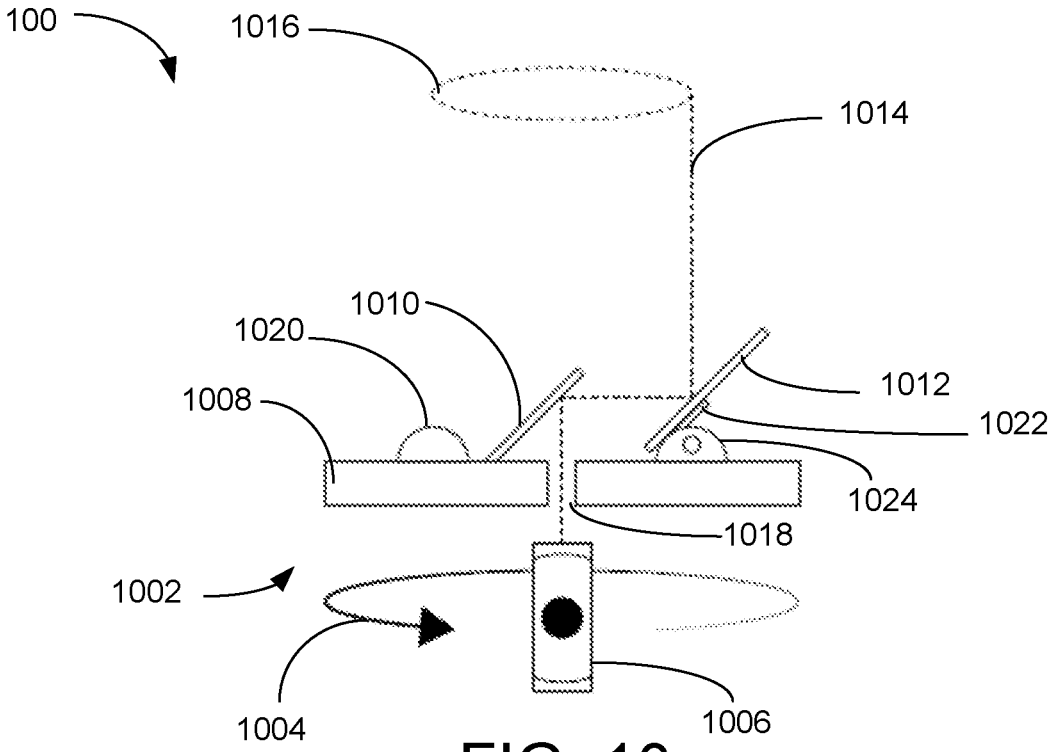
FIG. 10 is a side diagrammatic view illustrating an exemplary laser projector within the exemplary embodiment of the loudspeaker placement visualizer system of FIG. 1 in a first exemplary configuration, according to a preferred embodiment of the present invention.

FIG. 10 is a side diagrammatic view illustrating an exemplary laser projector 1002 within the exemplary embodiment of the loudspeaker placement visualizer system 100 of FIG. 1 in a first exemplary configuration, according to a preferred embodiment of the present invention. Spinning annular support 1008 enables laser beam 1014 from laser 1006 to pass through the central opening 1018 of the annular support 1008. During operation, annular support 1008 preferably rotates 1004 at a constant rate that is equal to or greater than sixty Hz. In some embodiments, laser 1006 and annular support 1008 are mechanically connected together and further connected to an electric motor 1810. In other embodiments, laser 1006 does not rotate and only annular support 1008 rotates in response to the electric motor 1810 (see FIG. 18).

Annular support 1008 supports fixed primary mirror 1010 and tilting secondary mirror 1012 on mirror support 1022 that is moved by an actuator 1024 in response to selection of a desired angle on the calibrations 208. Counterweight 1020 maintains balance. In operation, laser beam 1014 passes through the central opening 1018 and reflects off fixed primary mirror 1010 which directs the laser beam 1014 to the tilting secondary mirror 1012. Laser beam 1014 reflects off the tilting secondary mirror 1012, out of the transparent cap 216 (not shown is this view), and into the venue to make a circular pattern 1016 on surfaces of the venue. The relationship of the fixed primary mirror 1010 to the tilting secondary mirror 1012 is such that, with the tilting secondary mirror 1012 tilted to a horizontal position (relative to the drawing), the laser beam 1014 has a cone angle $\alpha$ of one hundred-eighty degrees. Such an angle is useful for installing omni-directional speakers. In some cases, two adjustable laser beam tools 102 may be used for one omni-directional speaker 104 or other wide dispersion speaker 104.

Figure 11:
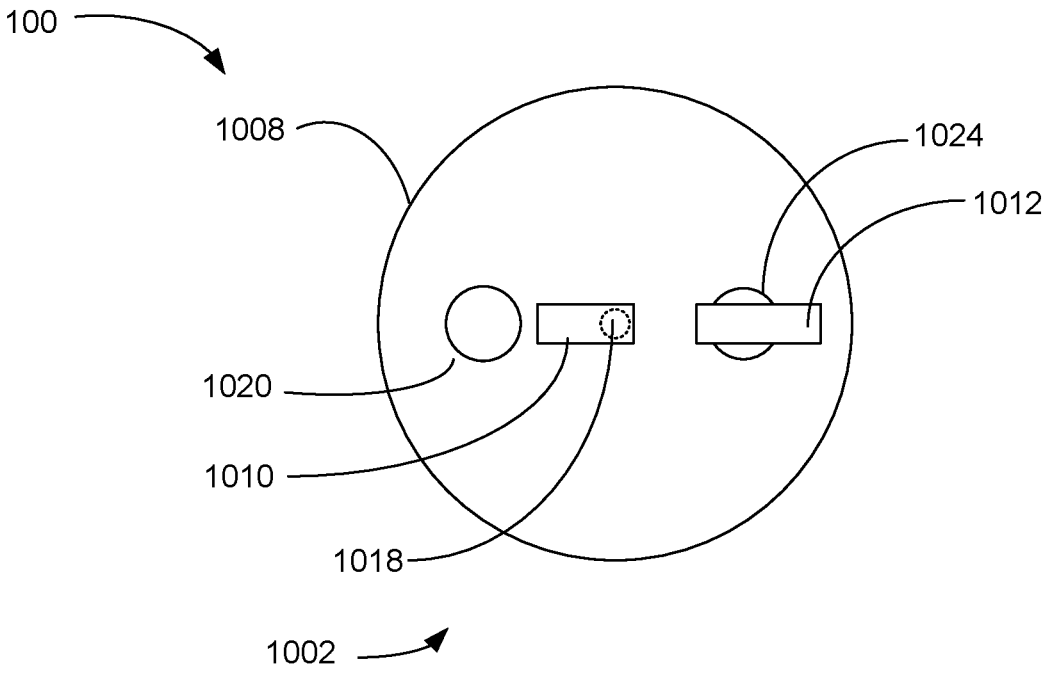
FIG. 11 is a top plan view illustrating the exemplary laser projector within the exemplary embodiment of the loudspeaker placement visualizer system of FIG. 1 in the first exemplary configuration, according to a preferred embodiment of the present invention.

FIG. 11 is a top plan diagrammatic view of the exemplary laser projector 1002 of FIG. 10 within the exemplary embodiment of the loudspeaker placement visualizer system 100 of FIG. 1 in the first exemplary configuration, according to a preferred embodiment of the present invention. In some embodiments, support 1008 need not be annular, but may be reduced in size to a minimum amount of structure to function as support 1008. Those of skill in the art, enlightened by the present disclosure, will understand how to perform trade-offs, in various embodiments, between the mass of the support, the benefit of a flywheel effect, and electric motor 1810 (see FIG. 18) sizing.

Figure 12:
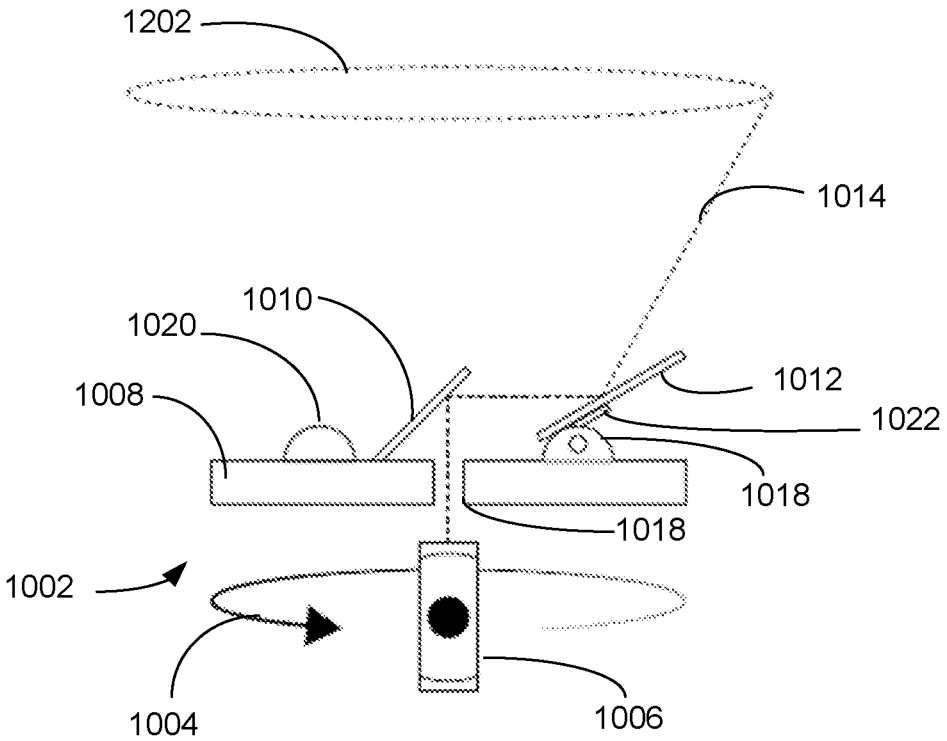
FIG. 12 is a side diagrammatic view illustrating the exemplary laser projector of FIG. 10 within the exemplary embodiment of the loudspeaker placement visualizer system of FIG. 1 in a second exemplary configuration, according to a preferred embodiment of the present invention.

FIG. 12 is a side diagrammatic view illustrating the exemplary laser projector 1002 of FIG. 10 within the exemplary embodiment of the loudspeaker placement visualizer system 100 of FIG. 1 in a second exemplary configuration, according to a preferred embodiment of the present invention. Tilting secondary mirror 1012 has been tilted to a lower angle resulting in a larger laser beam circular outline 1202 than in FIG. 10.

Figure 13:
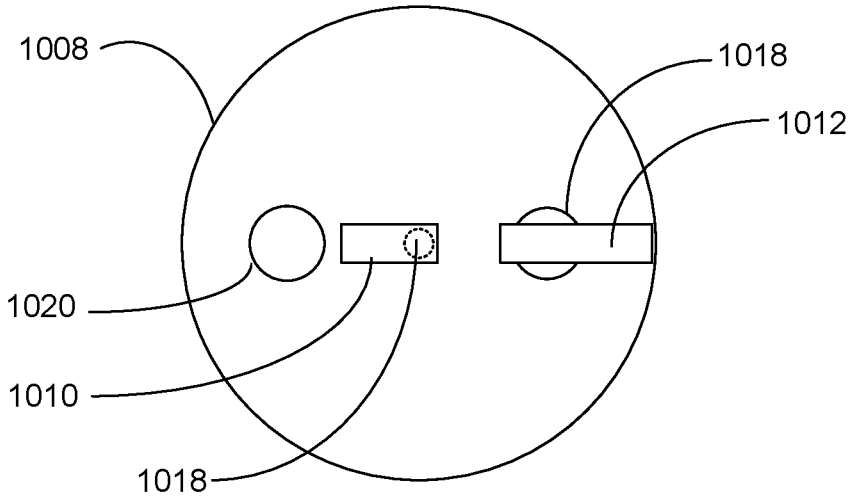
FIG. 13 is a top plan view illustrating the exemplary laser projector within the exemplary embodiment of the loudspeaker placement visualizer system of FIG. 1 in the first exemplary configuration, according to a preferred embodiment of the present invention.

FIG. 13 is a top plan diagrammatic view of the exemplary projector 1002 of FIG. 10 within the exemplary embodiment of the loudspeaker placement visualizer system 100 of FIG. 1 in the second exemplary configuration of FIG. 12, according to a preferred embodiment of the present invention. Tilting secondary mirror 1012 has been tilted to a lower angle in this second exemplary configuration.

FIG. 14 is a side diagrammatic elevation view illustrating the exemplary embodiment of the loudspeaker placement visualizer system 100 of FIG. 1, according to a preferred embodiment of the present invention. Loudspeaker cabinet 106 is shown with adjustable laser beam tool 102 releasably attached at two locations 1416 and 1418, although only one adjustable laser beam tool 102 per loudspeaker cabinet 106 would be typical. At side location 1406, bracket 1404 is oriented such that, when adjustable laser beam tool 102 is installed, center line 212 of adjustable laser beam tool 102 is parallel to centerline 110 of loudspeaker 104. Adjustable laser beam tool 102 is installed in bracket 1404 by inserting the adjustable laser beam tool 102 endwise between the resilient opposed bracket arms 1402 (one of two labeled) until only the transparent cap 216 extends beyond the front of loudspeaker cabinet 106, as shown. At top location 1408, bracket 1404 is oriented such that, when adjustable laser beam tool 102 is installed, center line 212 of adjustable laser beam tool 102 is parallel 1412 to centerline 110 of loudspeaker 104. Perfect parallelism is not required, but the greater the parallelism, the better the adjustable laser beam tool 102 will represent the acoustic field of regard of the loudspeaker 104. Adjustable laser beam tool 102 is installed in bracket 1404 by inserting the adjustable laser beam tool 102 endwise between the resilient opposed bracket arms 1402 until only the transparent cap 216 extends beyond the front of loudspeaker cabinet 106, as shown.

FIG. 15 is a front diagrammatic elevation view illustrating the exemplary embodiment of the loudspeaker placement visualizer system 100 of FIG. 1, according to a preferred embodiment of the present invention. Centerline 212 of top adjustable laser beam tool 102 is in a vertical plane 1502 through the centerline 110 of loudspeaker 104. Center line 212 of side adjustable laser beam tool 102 is in a horizontal plane 1504 through the centerline 110 of loudspeaker 104. Brackets 1404 are merely exemplary. Those of skill in the art, enlightened by the present disclosure, will appreciate the various types of brackets that may serve as brackets 1404.

FIG. 16 is a side diagrammatic elevation view illustrating the exemplary embodiment of the loudspeaker placement visualizer system 100 of FIG. 1, according to a preferred embodiment of the present invention. Bracket 1606 is attached to dust cap 1602 of speaker 104 and is aligned such that centerline 212 of the adjustable laser beam tool 102 is colinear with the centerline 110 of the loudspeaker 104. Bracket 1606 includes a resilient tubular receiver 1604 that receives an adjustable laser beam tool 102 endwise, as shown. Perfect collinearity is not required, but the greater the collinearity, the better the adjustable laser beam tool 102 will represent the acoustic field of regard of the loudspeaker 104.

FIG. 17 is a top plan diagrammatic view illustrating the exemplary embodiment of the loudspeaker placement visualizer system 100 of FIG. 1, according to a preferred embodiment of the present invention. Adjustable laser beam tool 102 is shown installed in resilient tubular receiver 1604 of bracket 1606. Those of skill in the art, enlightened by the present disclosure, will appreciate the various types of brackets that may serve as bracket 1606.

Figure 18:
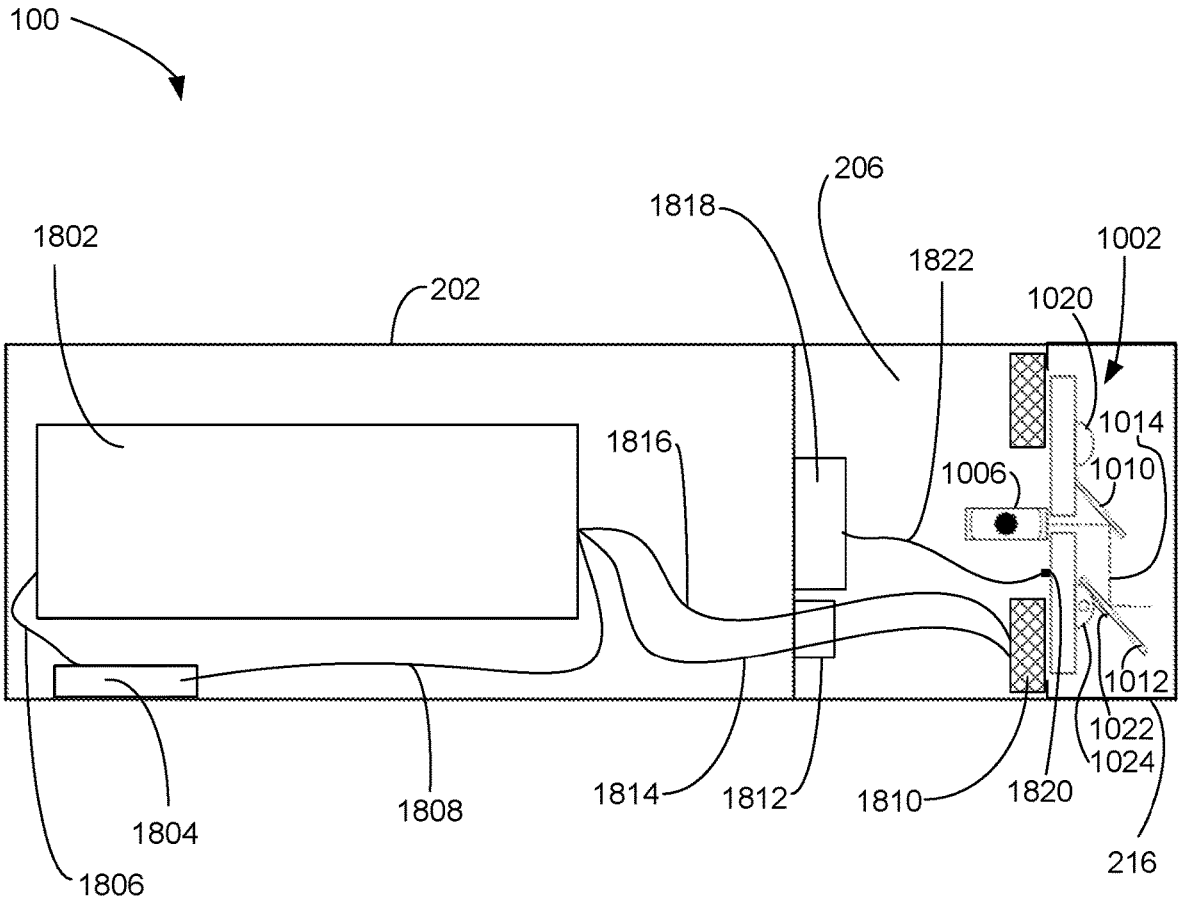
FIG. 18 is a side plan x-ray view illustrating the exemplary embodiment of the adjustable laser beam tool 102 of FIG. 1, according to a preferred embodiment of the present invention.

FIG. 18 is a side plan x-ray view illustrating the exemplary embodiment of the adjustable laser beam tool 102 of FIG. 1, according to a preferred embodiment of the present invention. Adjustable laser beam tool 102 has a battery 1802 that is rechargeable via USB recharging port and circuit 1804 via electrical conductors 1805 and 1808. Battery 1802 powers annular electric motor 1810 via electrical conductors 1814 and 1816 and ON/OFF switch 1812. Controller 1818 senses the selected laser beam cone angle α and sends the responsive control signal to actuator 1024 via signal conductor 1822 and commutator 1820 to tilt secondary mirror 1012 to the selected position. In a particular embodiment, ON/OFF switch 1812 is integral with the controller 1818 and turns to OFF when an angle less than the minimum possible is selected and turns ON when a possible angle is selected. Laser 1006 is also powered by the battery 1802 via the ON/OFF switch 1812, but the wires are omitted for simplicity of the drawing.

Another use for the adjustable laser beam tool 102 is to inspect an installation venue to determine placement, orientation and sound dispersion angle needed for each speaker 104. For example, an installer might stand on stage and adjust the calibrated 208 angle to the correct coverage area, and so be able to specify the required sound dispersion angle for the loudspeaker 104 to be installed.

The following claims contain some functional claiming and no statements of intended use.

I claim:

1. A loudspeaker placement visualizer system comprising:

a. an adjustable laser beam tool having calibrated beam cone angles;

b. a laser beam projector within said adjustable laser beam tool operable to produce a circular laser beam pattern responsive to a user-selected said calibrated laser beam cone angle.

2. The system of claim 1, wherein said laser beam cone angle is user-selectable to correspond to a sound dispersion angle of a particular loudspeaker.

3. The system of claim 2, comprising a bracket extending from a dust cap of said loudspeaker operable to support said adjustable laser beam tool in an orientation aligned to a long axis of said loudspeaker.

4. The system of claim 2, comprising at least one of:

a. a bracket extending from a side of a loudspeaker cabinet operable to:

i. support said adjustable laser beam tool in an orientation aligned parallel to a long axis of said loudspeaker; and ii. support said adjustable laser beam tool aligned to a central horizontal plane of said loudspeaker;

b. a bracket extending from a top of said loudspeaker cabinet operable to:

i. support said adjustable laser beam tool in an orientation aligned parallel to a long axis of said loudspeaker; and ii. support said adjustable laser beam tool aligned to a central vertical plane of said loudspeaker.

5. The system of claim 2, comprising at least one of:

a. a bracket extending from a dust cap of said loudspeaker operable to support said adjustable laser beam tool in an orientation aligned to a long axis of said loudspeaker;

b. a bracket extending from a side of a loudspeaker cabinet operable to:

i. support said adjustable laser beam tool in an orientation aligned parallel to a long axis of said loudspeaker; and ii. support said adjustable laser beam tool aligned to a central horizontal plane of said loudspeaker;

c. a bracket extending from a top of said loudspeaker cabinet operable to:

i. support said adjustable laser beam tool in an orientation aligned parallel to a long axis of said loudspeaker; and ii. support said adjustable laser beam tool aligned to a central vertical plane of said loudspeaker.

6. The system of claim 1, wherein said adjustable laser beam tool comprises:

a. a cylindrical main body having a long axis; and b. a forward section rotatable about the long axis of said cylindrical main body.

7. The system of claim 6, wherein said cylindrical main body:

a. comprises an external fixed reference indicator proximate a forward end of said cylindrical main body; and b. supports an internal power supply.

8. The system of claim 6, wherein said forward section:

a. comprises external angular calibrations proximate a rear end of said forward section;

b. supports a transparent cap; and c. supports a laser projector.

9. The system of claim 8, wherein said forward section comprises:

a. a rotatable laser projector operable to project a laser beam, creating a predetermined pattern, through said transparent cap; and b. an electric motor operable to rotate said rotatable laser projector.

10. The system of claim 9, wherein said predetermined pattern is a circular pattern.

11. The system of claim 10, wherein said rotatable laser projector comprises:

a. a base having a central opening;

b. a fixed primary mirror supported on said base and extending over said central opening;

c. a tiltable secondary mirror supported on a tilt actuator that is supported on said base;

d. wherein said tilt actuator is responsive to said user-selected calibrated beam cone angle.

12. The system of claim 1, wherein:

a. said adjustable laser beam tool is adjustable to determine a sound dispersion angle appropriate to a particular venue; and b. said loudspeaker is selectable responsive to said determined sound dispersion angle.

13. A loudspeaker placement visualizer system comprising:

a. an adjustable laser beam tool having calibrated beam cone angles;

b. a laser beam projector within said adjustable laser beam tool operable to produce a circular laser beam pattern responsive to a user-selected said calibrated laser beam cone angle; and c. wherein said laser beam cone angle is user-selectable to correspond to a sound dispersion angle of a particular loudspeaker.

14. The system of claim 13, wherein said adjustable laser beam tool comprises:

a. a cylindrical main body having a long axis; and b. a forward section rotatable about the long axis of said cylindrical main body.

15. The system of claim 14, wherein:

a. said cylindrical main body:

i. comprises an external fixed reference indicator proximate a forward end of said cylindrical main body; and ii. supports an internal power supply;

b. wherein said forward section:

i. comprises external angular calibrations proximate a rear end of said forward section; and ii. supports a transparent cap;

iii. supports a laser projector.

16. The system of claim 15, wherein said forward section comprises:

a. a rotatable laser projector operable to project a laser beam, creating a predetermined pattern, through said transparent cap; and b. an electric motor operable to rotate said rotatable laser projector.

17. The system of claim 15, wherein said rotatable laser projector comprises:

a. a base having a central opening;

b. a fixed primary mirror supported on said base and extending over said central opening;

c. a tiltable secondary mirror supported on a tilt actuator that is supported on said base;

d. wherein said tilt actuator is responsive to said user-selected calibrated beam cone angle; and e. wherein said predetermined pattern is a circular pattern.

18. The system of claim 13, wherein:

a. said adjustable laser beam tool is adjustable to determine a sound dispersion angle appropriate to a particular venue; and b. said loudspeaker is selectable responsive to said determined sound dispersion angle.

19. A loudspeaker placement visualizer system comprising:

a. an adjustable laser beam tool having calibrated beam cone angles;

b. a laser beam projector within said adjustable laser beam tool operable to produce a circular laser beam pattern responsive to a user-selected said calibrated laser beam cone angle; and c. wherein said laser beam cone angle is user-selectable to correspond to a sound dispersion angle of a particular loudspeaker;

d. wherein said adjustable laser beam tool comprises:

i. a cylindrical main body having a long axis; and ii. a forward section rotatable about the long axis of said cylindrical main body;

e. wherein:

i. said cylindrical main body:

1. comprises an external fixed reference indicator proximate a forward end of said cylindrical main body; and 2. supports an internal power supply;

ii. said forward section:

1. comprises external angular calibrations proximate a rear end of said forward section; and 2. supports a transparent cap;

3. supports a laser projector;

f. wherein said forward section further comprises:

i. a rotatable laser projector operable to project a laser beam, creating a predetermined pattern, through said transparent cap; and ii. an electric motor operable to rotate said rotatable laser projector;

g. wherein said rotatable laser projector comprises:

i. a base having a central opening;

ii. a fixed primary mirror supported on said base and extending over said central opening;

iii. a tiltable secondary mirror supported on a tilt actuator that is supported on said base;

iv. wherein said tilt actuator is responsive to said user-selected calibrated beam cone angle; and v. wherein said predetermined pattern is a circular pattern; and h. at least one of:

i. a bracket extending from a dust cap of said loudspeaker operable to support said adjustable laser beam tool in an orientation aligned to a long axis of said loudspeaker;

ii. a bracket extending from a side of a loudspeaker cabinet operable to:

1. support said adjustable laser beam tool in an orientation aligned parallel to a long axis of said loudspeaker; and 2. support said adjustable laser beam tool aligned to a central horizontal plane of said loudspeaker;

iii. a bracket extending from a top of said loudspeaker cabinet operable to:

1. support said adjustable laser beam tool in an orientation aligned parallel to a long axis of said loudspeaker; and a. support said adjustable laser beam tool aligned to a central vertical plane of said loudspeaker.

20. The system of claim 19, wherein:

a. said adjustable laser beam tool is adjustable to determine a sound dispersion angle appropriate to a particular venue; and b. said loudspeaker is selectable responsive to said determined sound dispersion angle.

* * * * *